US007819496B2

(12) United States Patent
Yamane

(10) Patent No.: US 7,819,496 B2
(45) Date of Patent: Oct. 26, 2010

(54) INKJET RECORDING APPARATUS

(75) Inventor: Toshiyuki Yamane, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 208 days.

(21) Appl. No.: 11/694,061

(22) Filed: Mar. 30, 2007

(65) Prior Publication Data

US 2007/0229571 A1 Oct. 4, 2007

(30) Foreign Application Priority Data

Mar. 30, 2006 (JP) ..... 2006-095947

(51) Int. Cl.
*B41J 29/38* (2006.01)

(52) U.S. Cl. ..... 347/16; 347/40; 347/12

(58) Field of Classification Search ..... 347/16, 347/40–42, 19, 5, 9, 12
See application file for complete search history.

(56) References Cited

U.S. PATENT DOCUMENTS

| | | | | |
|---|---|---|---|---|
| 2002/0008730 | A1* | 1/2002 | Mitsuzawa | 347/40 |
| 2004/0109037 | A1* | 6/2004 | Nunokawa et al. | 347/16 |
| 2004/0135836 | A1* | 7/2004 | Nunokawa | 347/16 |
| 2005/0088472 | A1 | 4/2005 | Nunokawa | |
| 2006/0192804 | A1 | 8/2006 | Nakata et al. | |

FOREIGN PATENT DOCUMENTS

| | | |
|---|---|---|
| JP | 7-476777 | 2/1995 |
| JP | 2004-216615 A | 8/2004 |
| JP | 2004-223748 A | 8/2004 |
| JP | 2005-028594 A | 2/2005 |
| JP | 2005-081780 A | 3/2005 |
| JP | 2005-349638 A | 12/2005 |
| JP | 2007-196490 A | 8/2007 |

OTHER PUBLICATIONS

JP Office Action dtd Dec. 22, 2009, JP Appln. 2006-095947, English translation.

* cited by examiner

*Primary Examiner*—Lam S Nguyen
(74) *Attorney, Agent, or Firm*—Banner & Witcoff, Ltd.

(57) ABSTRACT

An inkjet recording apparatus includes: a recording head that moves in a main scanning direction and ejects ink from a plurality of nozzles toward a recording medium to perform a main scan; a conveying mechanism that conveys the recording medium in a sub-scanning direction by a predetermined conveyance amount to perform a sub-scan; and a control unit that controls the recording head and the conveying mechanism to repeat the main scan and the sub-scan alternatively to eject the ink on the recording medium at a position upstream in the sub-scanning direction with an interval satisfying a required resolution from the ink ejected on the recording medium in a previous main scan, the control unit setting the predetermined conveyance amount greater than a theoretical conveyance amount set based on a number of the nozzles being used and the required resolution.

20 Claims, 15 Drawing Sheets

FIG. 4A

PRINTING METHOD TABLE

35a

| | |
|---|---|
| BLACK-AND-WHITE PRINTING | BK |
| COLOR PRINTING | Col |

FIG. 4B

SHEET TYPE TABLE

35b

| | |
|---|---|
| PLAIN PAPER 1 | P1 |
| PLAIN PAPER 2 | P2 |
| MAT PAPER | P3 |
| GLOSSY PAPER 1 | P4 |
| GLOSSY PAPER 2 | P5 |

FIG. 4C

CORRECTION PARAMETER TABLE

35c

| | |
|---|---|
| OUTSIDE-AIR TEMPERATURE | T |
| REQUIRED RESOLUTION | R |
| DRYING TIME | W |

INKJET RECORDING APPARATUS

CROSS-REFERENCE TO THE RELATED APPLICATION(S)

This application is based upon and claims priority from prior Japanese Patent Application No. 2006-095947 filed on Mar. 30, 2006, the entire content of which is incorporated herein by reference.

TECHNICAL FIELD

Aspects of the present invention relate to an inkjet recording apparatus that can improve recording quality.

BACKGROUND

Conventionally, an inkjet recording apparatus records an image on a recording media by repeating a main scan and a sub-scan. While the main scan, a head ejects ink to the recording medium and is reciprocated in a main scanning direction. The sub-scan conveys the recording medium in a sub-scanning direction. In this type of inkjet recording apparatus, image quality of a higher resolution than the pitch of nozzles arranged in the sub-scanning direction is sometimes required. Further, recording is carried out so as to fill a dot space formed by one main scan by the next main scan onward, and a recording method called interlace is known as one of the recording methods.

This interlace will be described as shown in FIG. 9A. As shown at the left of FIG. 9A, description will be given of a method for performing recording so as to satisfy a required resolution of 600 dpi by use of 93 nozzles in a head 100 having nozzles P pierced at a pitch of 1/150 inches in a sub-scanning direction B.

In this case, as illustrated at the right of FIG. 9A, a recording medium is conveyed by 93/600 inches in the sub-scanning direction B after one main scan (first pass). Then, after the next main scan (second pass) is carried out, the recording medium is again conveyed by 93/600 inches in the sub-scanning direction B. Recording continues while repeating such a main scan and sub scan. The diagram at the right of FIG. 9A illustrates a condition of the head 100 relatively moving with respect to the recording medium conveyed in the sub-scanning direction B, and the head 100 is illustrated in a manner displaced rightward for each main scan. Besides, the head 100 exists on an identical line at a start position of each main scan in actuality.

FIG. 10 is a diagram showing the condition illustrated at the right of the FIG. 9A in a further enlarged manner. The leftmost column of FIG. 10 indicates 1/600 inches per square. In addition, the column is omitted halfway in places for illustration. The adjacent right-hand column of the leftmost column shows nozzle numbers (blackened parts) to eject ink in the first pass. The adjacent right-hand column thereof shows nozzle numbers (blackened parts) to eject ink in the second pass after conveying the recording medium in the sub-scanning direction B by 93/600 inches after the first pass. The adjacent right-hand column thereof shows nozzle numbers (blackened parts) to eject ink in the third pass after conveying the recording medium in the sub-scanning direction B by 93/600 inches after the second pass. The adjacent right-hand column thereof shows nozzle numbers (blackened parts) to eject ink in the fourth pass after conveying the recording medium in the sub-scanning direction B by 93/600 inches after the third pass.

According to the above, a state that ink is ejected from the $70^{th}$ nozzle and the $71^{st}$ nozzle in the first pass, ink is ejected from the $47^{th}$ nozzle in the second pass, ink is ejected from the $24^{th}$ nozzle in the third pass, and ink is ejected from the $1^{st}$ nozzle in the fourth pass is detected, when attention is focused on the position of 276 to 280 (K part) in the leftmost column of FIG. 10.

The ink that is ejected from the $47^{th}$ nozzle in the second pass is ejected 1/600 inches upstream in the sub-scanning direction B of the ink that has been ejected from the $70^{th}$ nozzle in the first pass and has been ejected on the recording medium. The ink that is ejected from the $24^{th}$ nozzle in the third pass is ejected 1/600 inches upstream in the sub-scanning direction B of the ink that has been ejected from the $47^{th}$ nozzle in the second pass and has been ejected on the recording medium. The ink that is ejected from the $1^{st}$ nozzle in the fourth pass is ejected 1/600 inches upstream in the sub-scanning direction of the ink that has been ejected from the $24^{th}$ nozzle in the third pass and has been ejected on the recording medium. In other words, the ink that is ejected from the $1^{st}$ nozzle in the fourth pass is ejected 1/600 inches downstream in the sub-scanning direction B of the ink that has been ejected from the $71^{st}$ nozzle in the first pass and has been ejected on the recording medium.

FIG. 11A is a diagram showing a condition of the ink ejected from the K part of FIG. 10 having been ejected on a recording medium. Ejection drops D1 and D5 are formed at a pitch of 1/150 inches in the first pass. An ejection drop D2 is formed upstream in the sub-scanning direction B at a pitch of 1/600 inches with respect to the ejection drop D1 in the second pass. An ejection drop D3 is formed upstream in the sub-scanning direction B at a pitch of 1/600 inches with respect to the ejection drop D2 in the third pass. An ejection drop D4 is formed at a pitch of 1/600 inches with respect to the ejection drop D3 in the second pass. In this manner, recording can be performed so as to satisfy the required resolution 600 dpi by use of the 93 nozzles P in the head having nozzles P pierced at a pitch of 150 dpi.

However, in a case of recording by the interlace technique described above, the following problems have existed. FIG. 11B is a sectional diagram along an A-A section line of FIG. 11A. In the case of recording by interlacing, the ejection drop D2 to be formed in the second path is formed so as to be contiguous upstream in the sub-scanning direction B with respect to the ejection drop D1 formed in the first pass. Therefore, when the ejection drop D2 is formed before the ejection drop D1 has dried, the ejection drop D2 is drawn toward the ejection drop D1 (arrow Z direction) due to the effect of surface tension and the like of the ejection drop D1 (see the dotted line of the ejection drop (D2)). Accordingly, overlap between the ejection drop D1 and ejection drop (D2) increases. Further, overlap between the ejection drop (D2) and ejection drop D3 decreases. Therefore, a streaky unevenness of ink (banding) occurs and recording quality is degraded. With respect to this type of problem, JP-A-07-47677 discloses a method for performing recording so that recording dots in the sub-scanning direction are not contiguous to each other.

SUMMARY

As shown in FIG. 11A, when it is intended by using the method disclosed in JP-A-07-47677 to perform recording so as to satisfy the required resolution of 600 dpi by the head having nozzles P at a pitch of 150 dpi for ejecting ink so as not to be contiguous in the sub-scanning direction B with respect to the ejection drops D1 and D5 formed in the first pass, it is necessary to form the ink at the position of the ejection drop D3 in the second pass. Since there is no choice but to form the ink at the position of the ejection drop D2 or the ejection drop D4 in the following third pass, the ink ejected in the third pass is affected by the ejection drop D3 that has been formed earlier has not yet dried. Thus, there remains the problem that a streaky unevenness of ink (banding) occurs to degrade recording quality.

Aspects of the present invention provide an inkjet recording apparatus that can improve recording quality.

According to an aspect of the invention, there is provided an inkjet recording apparatus including: a recording head that moves in a main scanning direction and ejects ink from a plurality of nozzles toward a recording medium to perform a main scan; a conveying mechanism that conveys the recording medium in a sub-scanning direction by a predetermined conveyance amount to perform a sub-scan, the sub-scanning direction being configured to be perpendicular to the main scanning direction; and a control unit that controls the recording head and the conveying mechanism to repeat the main scan and the sub-scan alternatively to eject the ink on the recording medium at a position upstream in the sub-scanning direction with an interval satisfying a required resolution from the ink ejected on the recording medium in a previous main scan, the control unit setting the predetermined conveyance amount greater than a theoretical conveyance amount set based on a number of the nozzles being used and the required resolution.

According to another aspect of the invention, there is provided an inkjet recording apparatus including: a recording head that moves in a main scanning direction and ejects ink from a plurality of nozzles toward a recording medium to perform a main scan; a conveying mechanism that conveys the recording medium in a sub-scanning direction by a predetermined conveyance amount to perform a sub-scan, the sub-scanning direction being configured to be perpendicular to the main scanning direction; and a control unit that controls the recording head and the conveying mechanism to repeat the main scan and the sub-scan alternatively to eject the ink on the recording medium at a position downstream in the sub-scanning direction with an interval satisfying a required resolution from the ink ejected on the recording medium in a previous main scan, the control unit setting the predetermined conveyance amount to be smaller than a theoretical conveyance amount that is set based on a number of the nozzles being used and the required resolution.

BRIEF DESCRIPTION OF THE DRAWINGS

FIG. 4A is a view showing a printing method table; FIG. 4B is a view showing a sheet type table; FIG. 4C is a view showing a correction parameter table;

DETAILED DESCRIPTION

Figure 1:
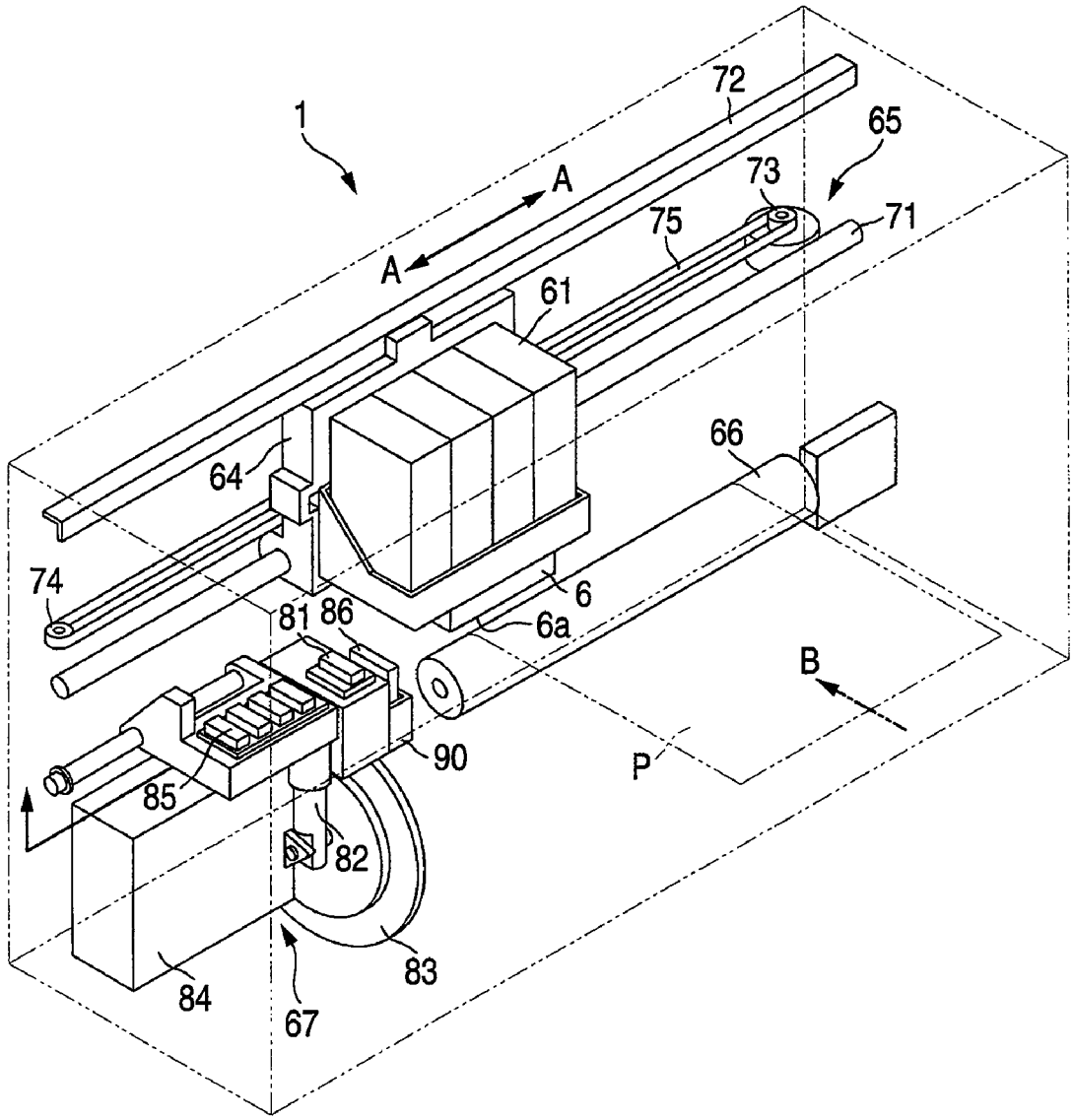
FIG. 1 is a perspective view showing a color inkjet printer as being an image forming apparatus of the present invention.
Figure 2:
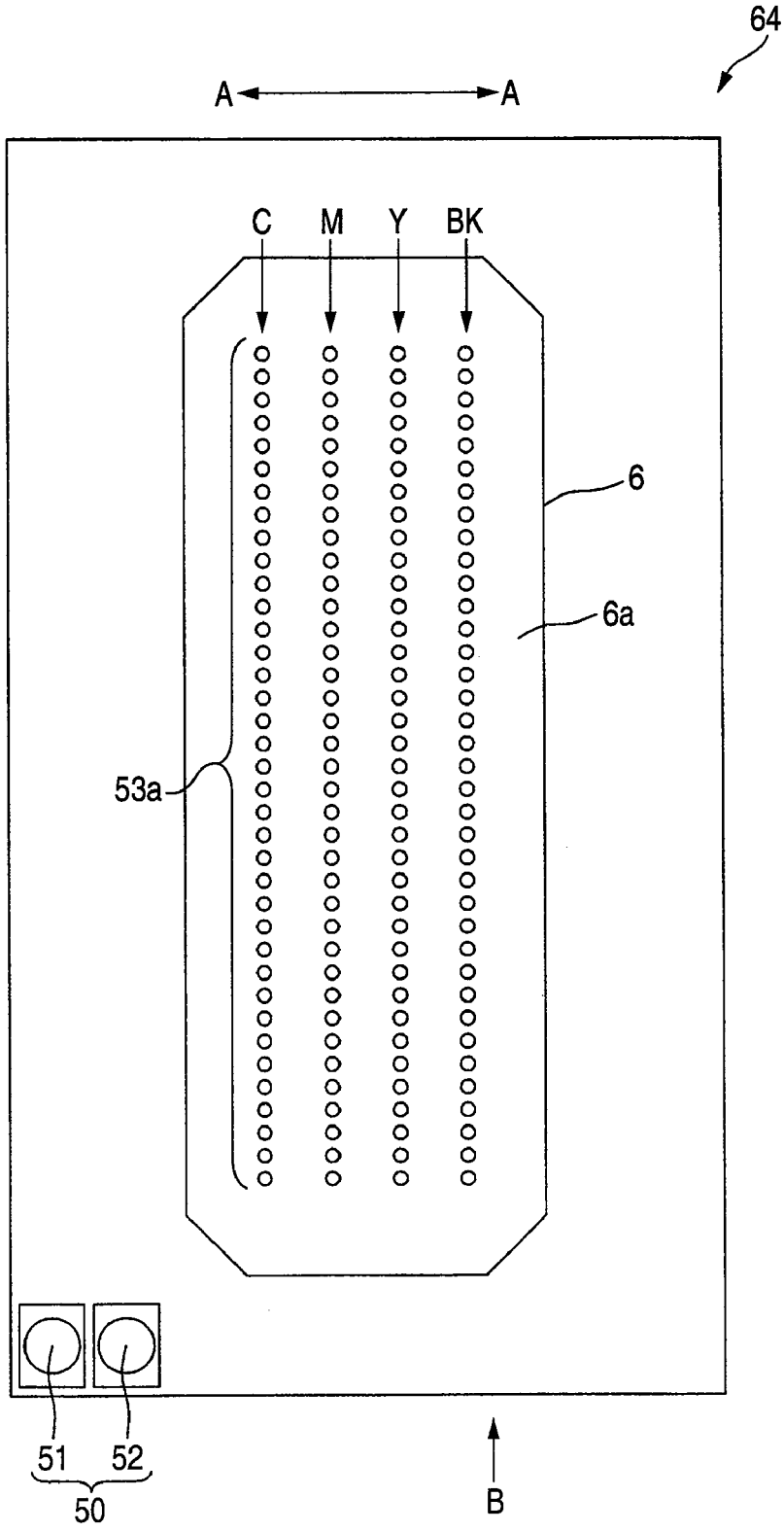
FIG. 2 is a view showing the bottom surface of a carriage.

Hereinafter, an aspect of the present invention will be described as shown in the accompanying drawings. FIG. 1 is a perspective view showing a color inkjet printer 1 as being an image forming apparatus of the present invention. FIG. 2 is a view showing the bottom surface of a carriage 64. The color inkjet printer 1 includes an ink cartridge 61, an inkjet head 6 for printing on a recording sheet of paper P, a carriage 64 on which the ink cartridge 61 and the inkjet head 6 are loaded, a drive unit 65 that reciprocates the carriage 64 in an arrow A direction (main scanning direction), a platen 66, and a purging device 67. Besides, for example, four color inks of cyan (C), magenta (M), yellow (Y), and black (Bk) are respectively filled in the ink cartridge 61. The platen 66 is extended in the reciprocating direction A of the carriage 64 and is disposed so as to be opposed to the inkjet head 6.

The drive unit 65 includes a carriage shaft 71, a guide plate 72, two pulleys 73 and 74, and an endless belt 75 stretched across between these pulleys 73 and 74. The carriage shaft 71 is disposed at a lower end portion of the carriage 64 and is extended parallel to the platen 66. The guide plate 72 is disposed at an upper end portion of the carriage 64 and is extended parallel to the carriage shaft 71. The two pulleys 73 and 74 disposed at both end sides of the carriage shaft 71 between the carriage shaft 71 and guide plate 72. When one pulley 73 is rotated normally and reversely by a drive of a CR motor 16 (see FIG. 3), with the normal and reverse rotation of one pulley 73, the carriage 64 joined to the endless belt 75 is reciprocated along the carriage shaft 71 and the guide plate 72 in the arrow A direction being a main scanning direction.

For the inkjet head 6, as shown in FIG. 2, nozzles 53*a* are provided in a row on a lower surface 6*a* thereof in a conveying direction B (sub-scanning direction B) of the recording sheet of paper P for each color ink of CMYBk. In the present aspect, it is provided that the nozzles 53*a* are pierced at a pitch of 1/150 inches in the sub-scanning direction B. Here, the pitch and number of nozzles 53*a* in the arranging direction are appropriately set in consideration of resolution and the like of a recording image. In addition, it is also possible to increase or decrease the number of rows of the nozzles 53*a* according to the number of types of the color ink.

In addition, as shown in FIG. 2, on the carriage 64, a media sensor 50 is loaded beside the ink cartridge 61 and the inkjet head 6. The media sensor 50 includes a light emitting section 51 formed of a light-emitting diode and a light receiving section 52 formed of an optical sensor. The light emitting section 51 of the media sensor 50 is constructed so as to emit light toward the platen 66 and so that a reflected light of the light is received by the light receiving section 52.

A top surface color of the platen 66 is composed of a color different in reflectance from the recording sheet of paper P, for example, black. When no recording sheet of paper P exists, the light receiving section 52 receives a reflected light from the platen 66 having a low reflectance. Therefore, a detection value (AD value) of the media sensor 50 results in a low value. On the other hand, when a recording sheet of paper P exists, the light receiving section 52 receives a reflected light from the recording sheet of paper P having a high reflectance. Therefore, a detection value (AD value) of the media sensor 50 results in a high value. Accordingly, existence of the recording sheet of paper P can be detected by a difference in the amount of reflected light received by the light receiving section 52.

Such a media sensor 50 is loaded on the carriage 64 upstream in the conveying direction of the recording sheet of paper P is reciprocated in the scanning direction with the carriage 64. As a result of the media sensor 50 being loaded on the carriage 64 along with the inkjet head 6, it is not necessary to provide a carriage for causing the media sensor 50 to scan separately from the carriage 64 for causing the inkjet head 6 to scan. Therefore, there is an advantage that the apparatus can be reduced in size. Moreover, in the carriage 64, the media sensor 50 is arranged upstream in the conveying direction of the inkjet head 6. Therefore, a left and right end position of the recording sheet of paper P can be detected by the media sensor 50 before image recording is carried out on the recording sheet of paper P.

Again returning to FIG. 1, description will be continued. The recording sheet of paper P is fed from a paper feed cassette (unillustrated) of the color inkjet printer 1, and is conveyed between the lower surface 6*a* of the inkjet head 6 and the platen 66 from the arrow B direction (sub-scanning direction: direction orthogonal to the main scanning direction A) via a conveying roller 60 (see FIG. 3). Then, the recording sheet of paper P is printed by the ink ejected from the nozzle 53*a*, and is then ejected. Here, in FIG. 1, illustration of a paper feed mechanism and a paper ejection mechanism of the sheet of paper P is omitted.

Lateral to the platen 66 along the moving direction of the carriage 64, the purging device 67 for recovering the inkjet head 6 from an ejection failure is disposed. The inkjet head 6 has an ejection failure due to the reason that bubbles are generated in the ink, the ink thickens, and the like. The purging device 67 is provided so as to restore the inkjet head 6 that has had an ejection failure to a satisfactory ejecting condition.

This purging device 67 is disposed so as to be opposed to the inkjet head 6 when a head unit 63 is located at a purging position, and includes a purge cap 81, a pump 82 and cam 83, and an ink retaining section 84. The purge cap 81 is closely fitted to the lower surface 6*a* of the inkjet head 6 to suction a defective ink containing bubbles or the like retained inside the inkjet head 6. Suction of the pump 82 is carried out by reciprocating a piston in the pump 82 by rotating the cam 83. In this manner, the inkjet head 6 is restored from a spot failure by suctioning the defective ink. In addition, the suctioned defective ink is retained in the ink retaining section 84.

On the platen 66 side of the purge cap 81, a wiper member 86 that is relatively movable with respect to the inkjet head 6 is disposed, and a cap 85 is disposed at a position to sandwich the purge cap 81 with the wiper member 86. The wiper member 86 is formed of an elastic material such as an ethylene-propylene rubber into a plate-like shape, and an end portion thereof is inserted in a wiper holder 90 and supported. The wiper member 86 is disposed in a manner protruded to the inkjet head 6 side, and wipes away the ink and the like remaining on the lower surface 6*a* of the inkjet head 6 with a movement of the carriage 64. The cap 85 prevents the ink from evaporating by covering the nozzles 53*a* formed on the inkjet head 6.

Figure 3:
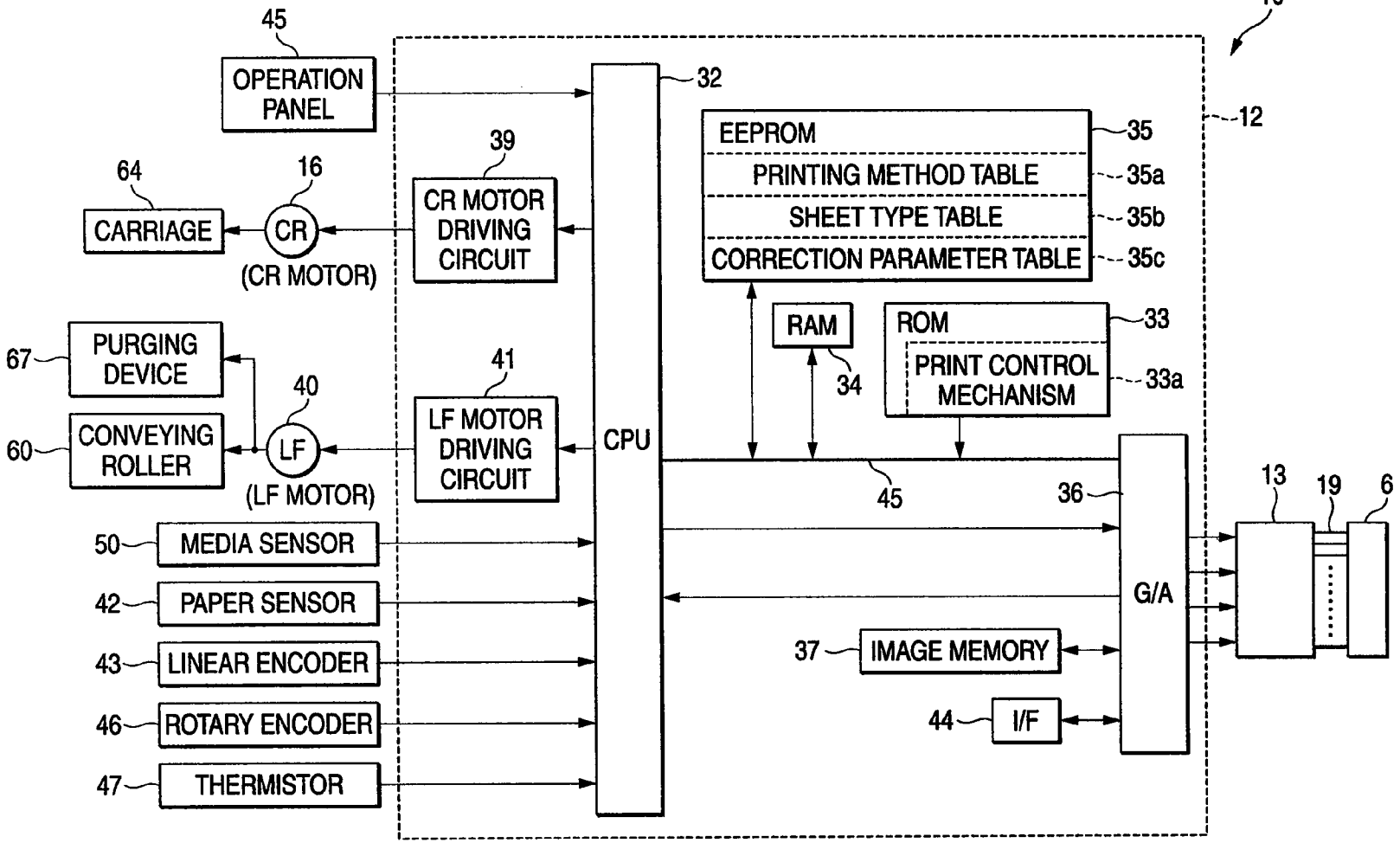
FIG. 3 is a block diagram showing an outline of the electrical circuit configuration of a color inkjet printer.

FIG. 3 is a block diagram showing an outline of the electrical circuit configuration of the color inkjet printer 1. A controller for controlling the color inkjet printer 1 includes a body-side control board 12 and a carriage board 13. The body-side control board 12 is loaded with a one-chip microcomputer (CPU) 32, a ROM 33 that stores various types of control programs executed by the CPU 32 and fixed value data, and a RAM 34 being a memory for temporarily storing various types of data and the like, an EEPROM 35, an image memory 37, a G/A (gate array) 36, and the like.

The CPU 32 being an arithmetic unit generates a print timing signal and a reset signal in accordance with the control programs stored in advance in the ROM 33, and transfers the respective signals to a gate array 36 to be described later. In addition, the CPU 32 is connected with an operation panel 45 for a print instruction and the like by a user, a CR motor driving circuit 39 for driving the carriage motor (CR motor) 16 that operates the carriage 64, an LF motor driving circuit 41 for operating a conveying motor (LF motor) 40 for driving the conveying roller 60 (purging device 67), the media sensor 50, a paper sensor 42, a linear encoder 43, a rotary encoder 46, and a thermistor 47 that detects an outside-air temperature. Operation of the respective connected devices is controlled by the CPU 32.

The paper sensor 42 is a sensor that detects the leading edge of a recording sheet of paper P, is arranged further upstream than the conveying roller 60, and is composed of, for example, a probe that turns as a result of contact with the recording sheet of paper P and a photointerrupter that detects a turn of the probe. The linear encoder 43 is for detecting the amount of movement of the carriage 64, and by detecting the encoding amount of the linear encoder 43 by the unillustrated photointerrupter reciprocation of the carriage 64 is controlled. The rotary encoder 46 is for detecting the amount of rotation of the conveying roller 60, and by detecting the encoding amount of the rotary encoder 46 by the unillustrated photointerrupter, the conveying roller 60 is controlled. That is, the rotary encoder 46 can detect an actual conveying position of the recording sheet of paper P conveyed by the conveying roller 60 at a predetermined accuracy.

In the ROM 33, a print control program 33*a* is stored as a program to execute a printing process (see FIG. 5) to be described later. The print control program 33*a* is configured so as to enable recording so that, with respect to ink ejected on the recording sheet of paper P by one main scan, ink ejected on the recording sheet of paper P by the next main scan is contiguous upstream in the sub-scanning direction at an interval satisfying a required resolution by alternately repeating a main scan that reciprocates the inkjet head 6 loaded on the carriage 64 in the main scanning direction A (see FIG. 1) to eject ink toward the recording sheet of paper P from the nozzles 53*a* and a sub-scan to convey the recording sheet of paper P by a predetermined conveyance amount in the sub-scanning direction B.

Figure 9A:
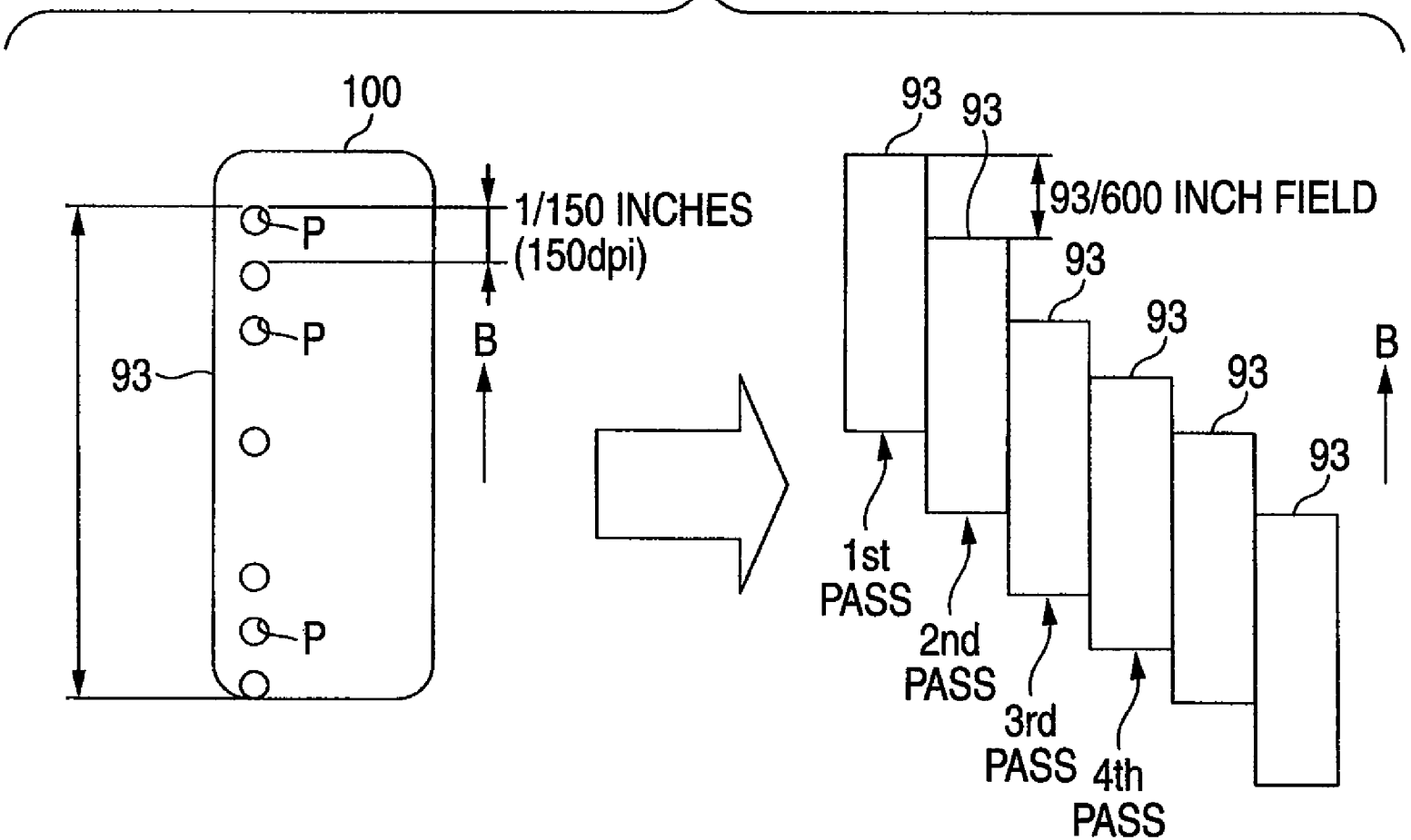
FIGS. 9A and 9B are diagrams for explaining interlace.
Figure 9B:
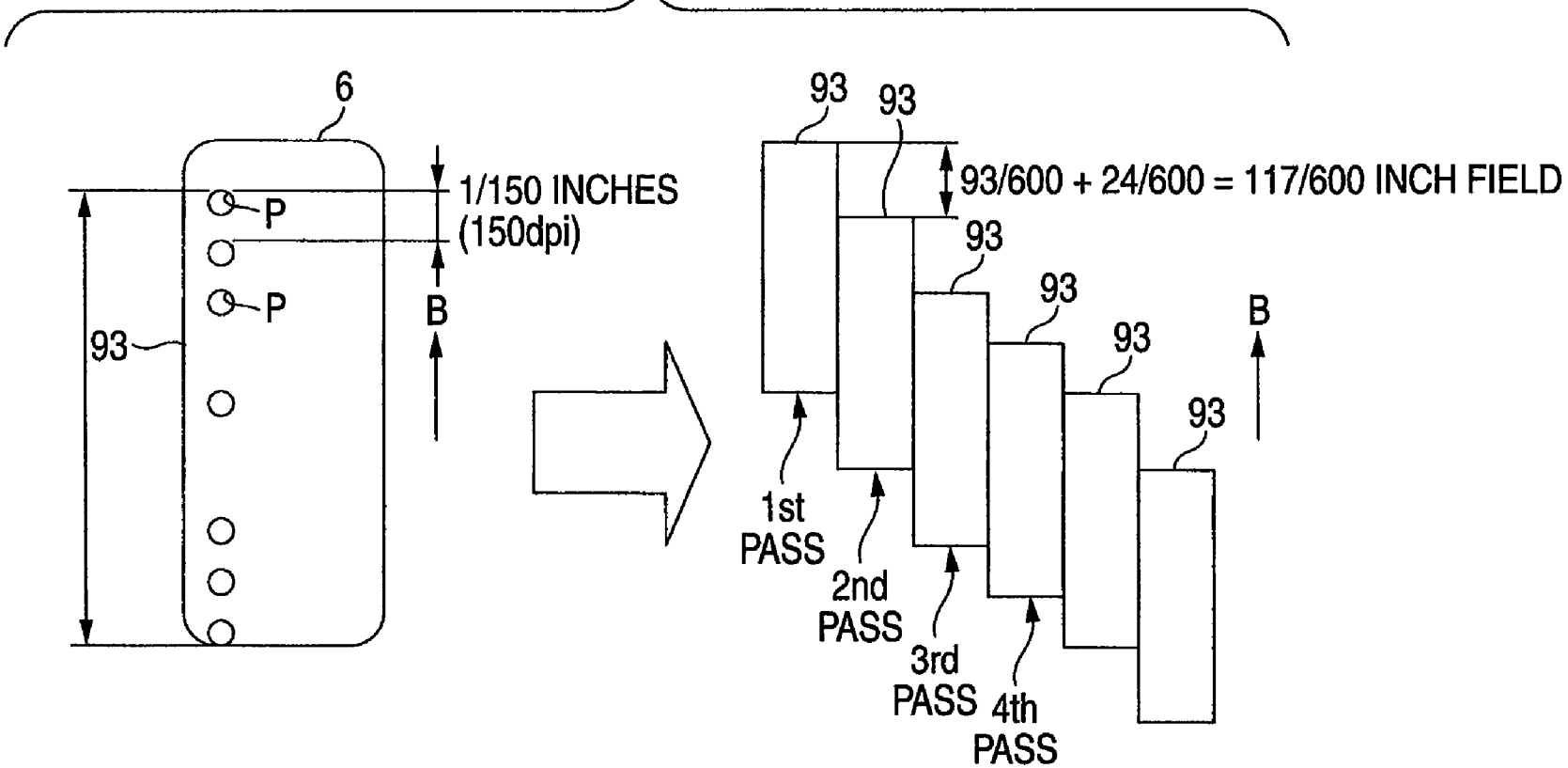
Figure 10:
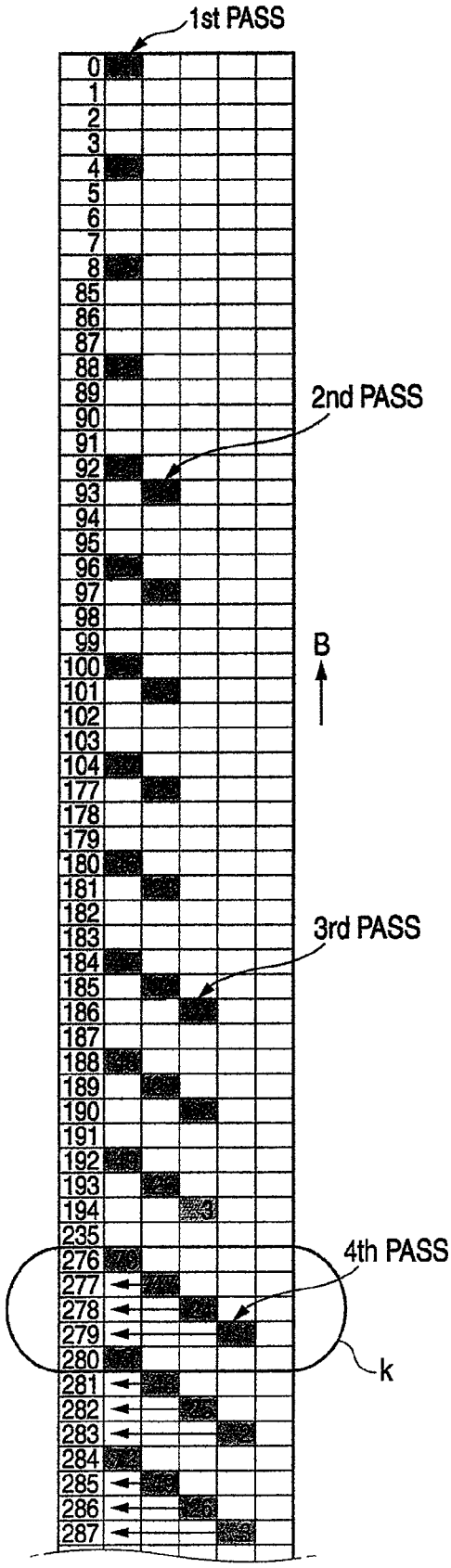
FIG. 10 is a diagram for explaining interlace.

Here, referring to FIG. 9B and FIG. 11C, a recording method executed by the print control mechanism 33*a* will be described in comparison with the conventional recording method. As shown in FIG. 9B, description will be given of a method for performing recording so as to satisfy a required resolution of 600 dpi by use of 93 nozzles P in the inkjet head 6 having nozzles P pierced at a pitch of 1/150 inches.

In this case, as shown at the left of FIG. 9B, after one main scan (first pass), the recording medium is conveyed by 117/600 inches in the sub-scanning direction B. Then, after carrying out the next main scan (second pass), again, the recording medium is conveyed by 117/600 inches in the sub-scanning direction B. Such a main scan and sub-scan are repeated to continue recording. In this connection, the diagram at the left of FIG. 9B illustrates a condition of the inkjet head 6 relatively moving with respect to the recording medium conveyed in the sub-scanning direction B, and the inkjet head 6 is illustrated in a manner displaced rightward for each main scan, however, in actuality, the inkjet head 6 exists on an identical line at each main scan.

That is, the recording method of the present aspect is different from the conventional recording method in the conveyance amount by one sub-scanning direction B. Concretely, in the case of the present aspect, the conveyance amount is 117/600 inches by one sub-scanning direction B, while it is 93/600 inches in the conventional case, and thus in the case of the present invention, the recording sheet of paper P is conveyed in the sub-scanning direction B 24/600 inches greater than in the conventional case.

Figure 11A:
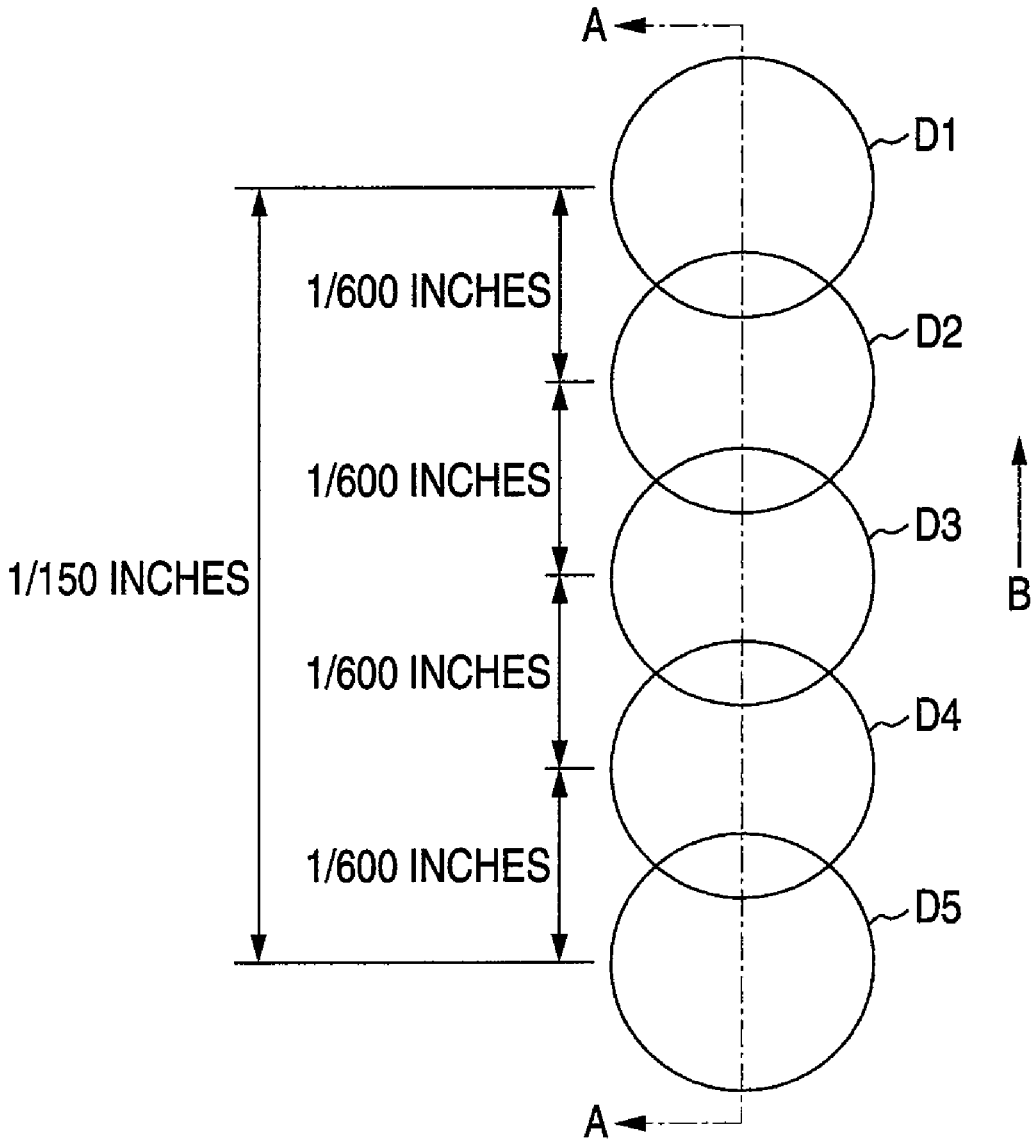
FIGS. 11A to 11C are diagrams for explaining interlace.
Figures 11B, 11C:
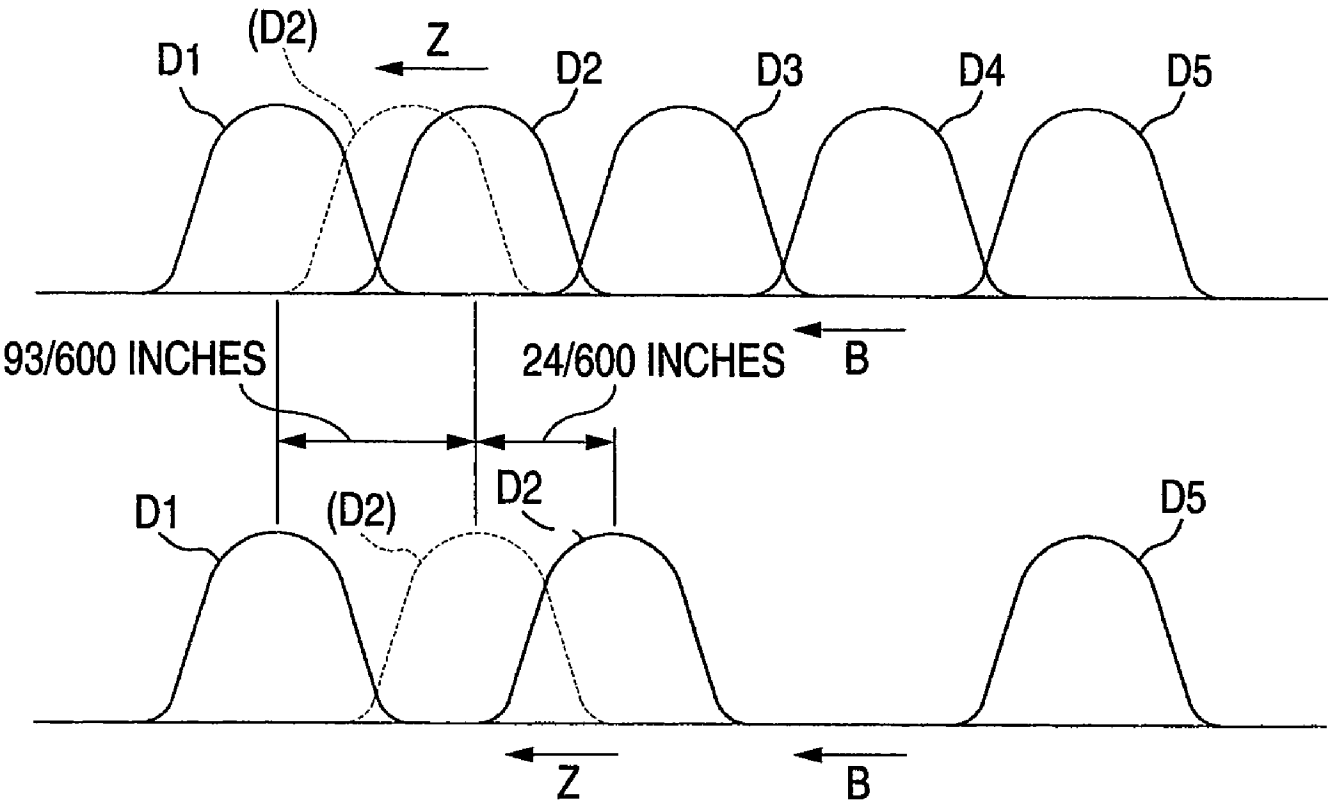

Therefore, in the case of the present aspect, as shown in FIG. 11(*c*), an ejection drop D2 formed in the second pass is ejected 24/600 inches further upstream in the sub-scanning direction B than an ejection drop D2 formed in the conventional second pass shown in FIG. 11(*b*). Consequently, in the case of the present aspect, the ejection drop D2 formed in the second pass is drawn to an undried ejection drop D1 formed in the first pass (see ejection drop (D2) shown by the dotted line of FIG. 11(*c*)), and is finally fixed at an optimal position, and thus occurrence of a streaky unevenness of ink (banding) is suppressed, so that recording quality can be improved.

In the EEPROM 35, a printing method table 35*a*, a sheet type table 35*b*, and a correction parameter table 35*c* are stored as various tables to acquire, in a correction value acquisition process to be described later (see FIG. 7), a correction value concerning a conveyance amount of the recording medium.

Description will be given of the respective tables as shown in FIGS. 4A to 4C. FIG. 4A is a view showing a printing method table 35*a*. The printing method table 35*a* is sectioned into black-and-white printing and color printing according to printing methods, and a correction value "BK" is stored for the black-and-while printing, and a correction value "Col," for the color printing. Between the correction value "BK" and the correction value "Col," the correction value "BK" is set greater than the correction value "Col." This is because, between a black ink made mainly from pigments and color inks (cyan, magenta, and yellow) made mainly from dyes, the black ink dries less easily and the ink easily spreads on the recording medium, and the correction value is set greater than that of color printing in the case of black-and-white printing that uses a large amount of black ink.

FIG. 4B is a view showing a sheet type table 35*b*. The sheet type table 35*b* is sectioned into a plain paper 1, a plain paper 2, a mat paper (inkjet paper), a glossy paper 1, and a glossy paper 2, and a correction value "P1" is stored for the plain paper 1, and a correction value "P2," for the plain paper 2, and a correction value "P3 ," for the mat paper (inkjet paper), and a correction value "P4," for the glossy paper 1, and a correction value "P5," for the glossy paper 2. With regard to the respective correction values, the higher ink penetration is, the greater the correction value is set. The correction values are set so as to be greater in order of the plain paper, mat paper (inkjet paper), and glossy paper. In addition, for the recording medium of an identical type, for example, the plain paper land the plain paper 2, correction values according to manufacturers of the respective plain papers are stored.

FIG. 4C is a view showing a correction parameter table 35*c*. The correction parameter table 35*c* is sectioned into an outside-air temperature, a required resolution, and a drying time, and a parameter "T" is stored for the outside-air temperature, a parameter "R," for the required resolution, and a parameter "W," for the drying time, based on experimental results. Correction values are calculated by multiplying the respective parameters by an actual outside-air temperature, required resolution, and drying time. Concretely, the parameter "T" is set so that, the higher the outside-air temperature is, the greater the correction value becomes, as the ink spreads more easily. In addition, the parameter "R" is set so that, the lower the required resolution is, the greater the correction value becomes, as the ink spreads more easily. That is, in the case of a high resolution, since a smaller ink drop than that in the case of a low resolution is ejected, this is hardly affected by a contiguous ejection drop. Furthermore, the parameter "W" is set so that, the shorter the drying time is, the greater the correction value becomes, as the ink spreads more easily. Here, the drying time means a time required from one main scan to the next main scan, and it is set so that the shorter the time is, the greater the correction value becomes. Concretely, when main scans are carried out at the same speed, it is set between unidirectional printing and bidirectional printing so that the correction value becomes greater in the case of bidirectional printing.

The G/A 36 outputs, based on a timing signal transferred from the CPU 32 and image data stored in the image memory 37, recording data (drive signal) for recording the image data on the recording sheet of paper P, a transfer clock being in synchronization with the recording data, a latch signal, a parameter signal for generating a basic drive waveform signal, and a eject timing signal outputted at a fixed cycle, and transfers these respective signals to the carriage board 13 mounted with a head driver.

In addition, the G/A 36 stores image data transferred via an interface (I/F) 44 such as a USB from an external device such as a computer in the image memory 37. Then, the G/A 36 generates a data reception interrupt signal based on data transferred via the I/F 44 from a computer or the like and transfers the signal to the CPU 32.

The carriage board 13 is a board to drive the inkjet head 6 by the head driver (driving circuit) mounted thereon. The inkjet head 6 is connected with the head driver via a flexible wiring board 19 for which a copper foil wiring pattern is formed on a polyimide film having a thickness of 50 to 150 μm. The head driver is controlled via the G/A 36 mounted on the body-side control board 12 and applies a drive pulse having a waveform that matches the recording mode to a piezoelectric actuator of the inkjet head. Thereby, the ink is ejected at a predetermined amount.

Figure 5:
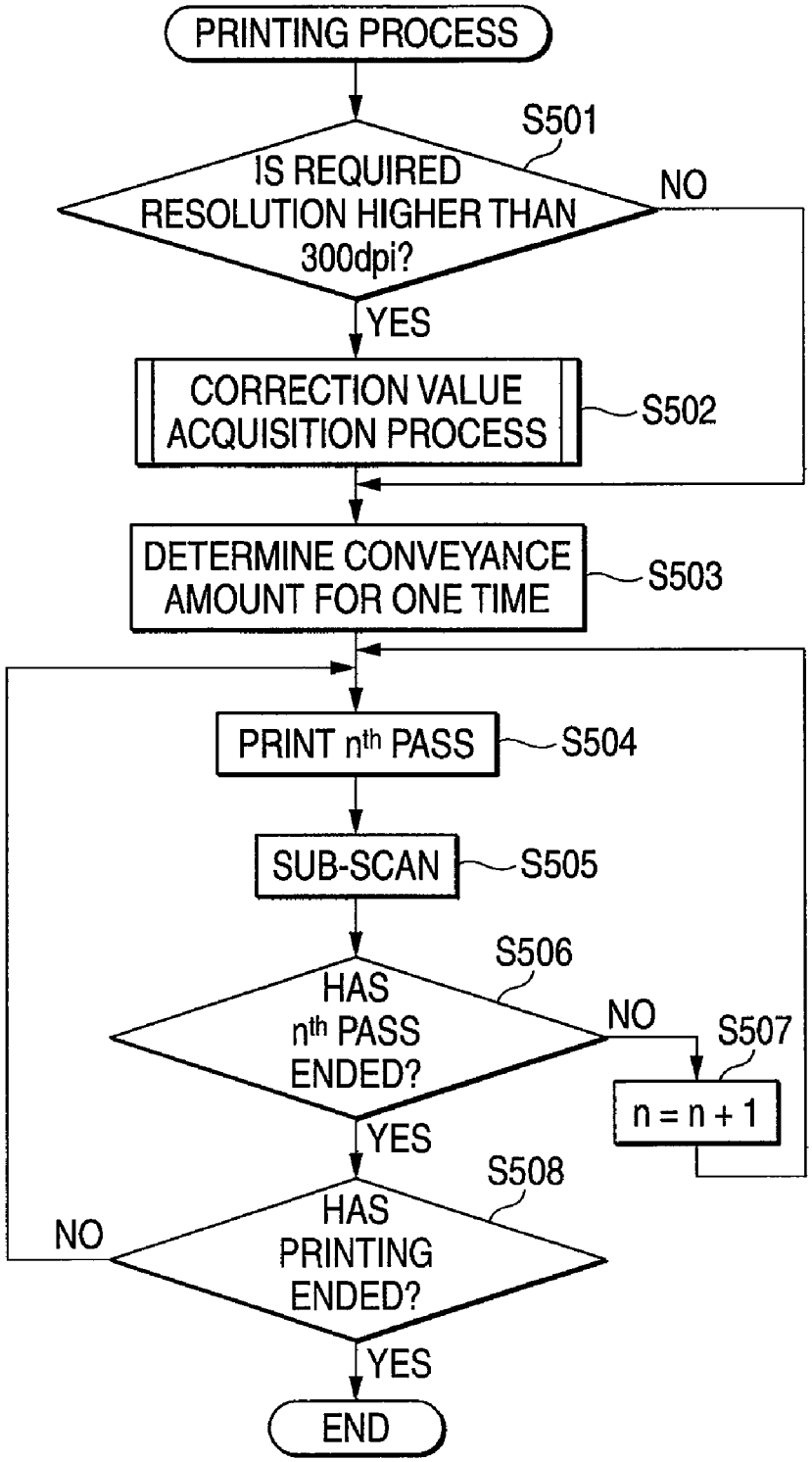
FIG. 5 is a flowchart of a printing process.

Next, description will be given of a printing process of the color inkjet printer 1 configured as described above as shown in FIG. 5. FIG. 5 is a flowchart showing a printing process. This process is executed by the CPU 32 in accordance with the print control program 33*a*.

In the printing process, when print data is transmitted, it is determined whether the required resolution is higher than 300 dpi based on the transmitted print data (S501). If the required resolution is higher than 300 dpi (S501: Yes), a correction value acquisition process to be described later is executed (S502), and a correction amount of the recording sheet of paper P conveyed by one sub-scan is acquired. And, a conveyance amount by one sub-scan is determined based on the acquired correction amount and a theoretical conveyance amount (S503). On the other hand, when the required resolution is equal to or lower than 300 dpi (S501: No), the process of S502 is skipped, that is, without carrying out a correction concerning the conveyance amount, the theoretical conveyance amount is determined as a conveyance amount by one sub-scan in the process of S503.

Next, the first-pass printing is carried out as a main scan (S504), and then, the recording sheet of paper P is conveyed in the sub-scanning direction B at the conveyance amount determined in S503 as a sub-scan (S505). And, it is determined whether the $n^{th}$-pass printing has ended so as to satisfy the required resolution (S506), and if it has not ended (S506: Bo), "1" is added to n (S507) to repeat the process from S504, and if it has ended (S506: Yes), it is determined whether printing has ended (S508), and if it has not ended (S508: No), the process from S504 is repeated, and if it has ended (S508: Yes), the current process is finished.

Figure 6A:
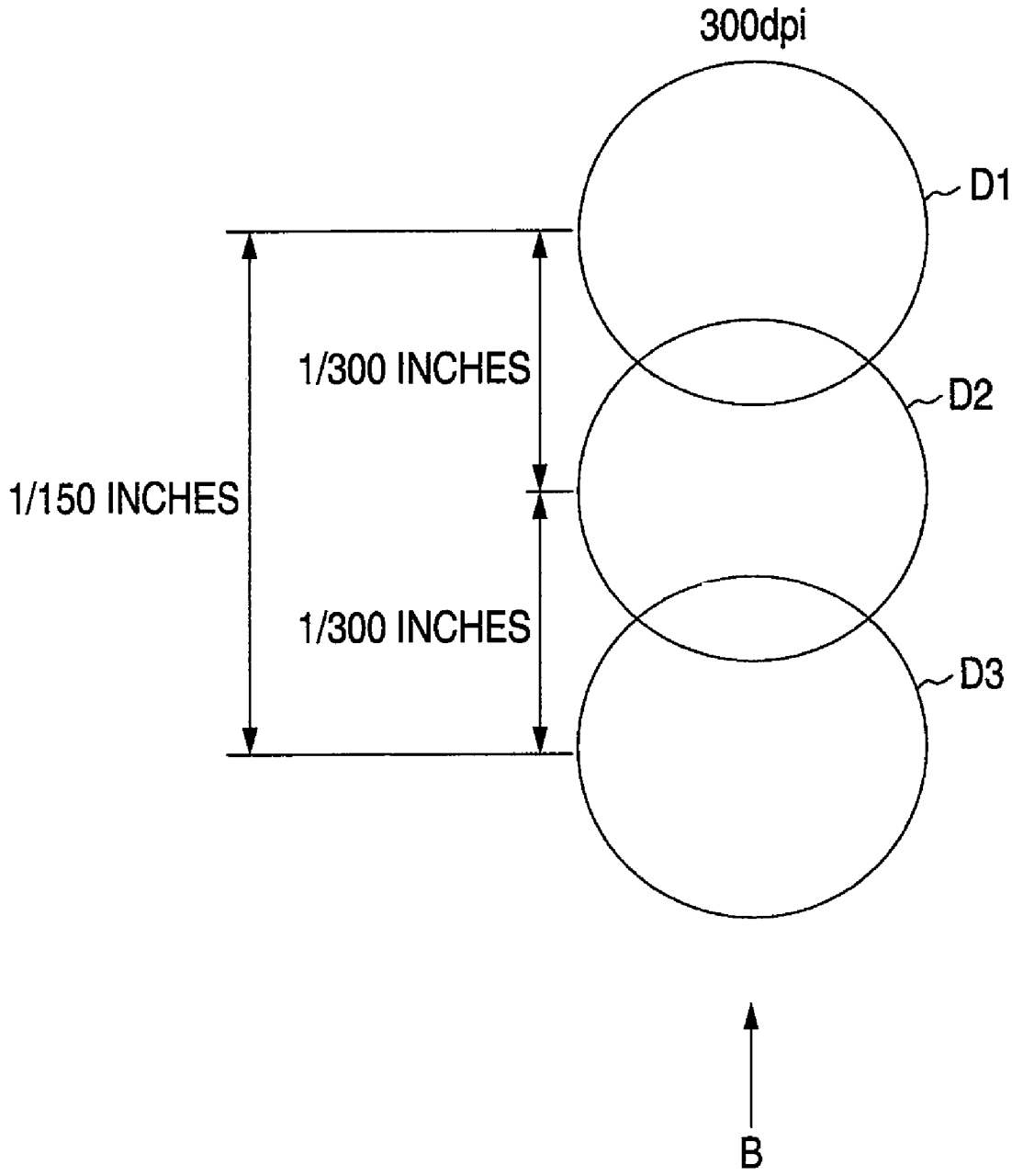
FIGS. 6A and 6B are diagrams for explaining limitation of a required resolution.
Figure 6B:
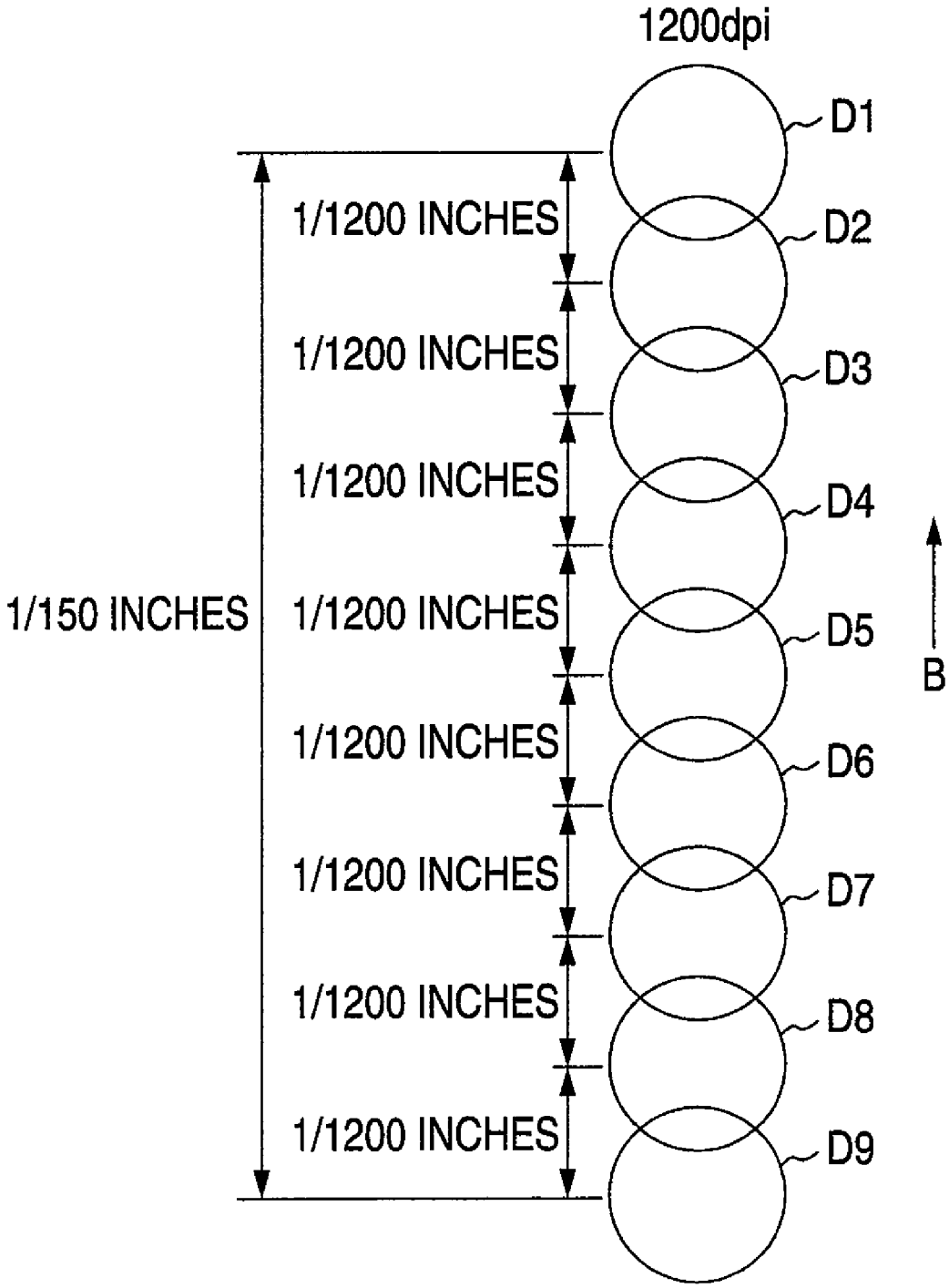

As shown in FIG. 6A, description will be given of a case where the required resolution is 300 dpi in the process of S501 of the flowchart of the printing process shown in FIG. 5. FIGS. 6A and 6B illustrate ink ejection drops when the required resolution is 300 dpi. As described above, in this case, the correction value acquisition process (S502) is not executed.

When the required resolution is equal to or lower than 300 dpi, it is necessary to form the ejection drop D2 in the second pass at almost the center of the ejection drops D1 and D3 formed in the first pass. In this case, the conveyance amount of the recording medium is provided greater than the theoretical conveyance amount, the ejection drop D2 is ejected at a position moved further upstream in the sub-scanning direction B than the almost center of the ejection drops D1 and D3.

In such a case, similar to the ejection drop D1 formed in the first pass, the ejection drop D3 has also not yet dried, the ejection drop D2 is further drawn toward the ejection drop D3, and a streaky unevenness of ink occurs to degrade recording quality. Therefore, when the required resolution is equal to or lower than 300 dpi, without executing a correction of the conveyance amount, the recording medium is conveyed as determined by the theoretical conveyance amount. Thereby, not only can recording quality be improved, but also the process load to calculate the correction value can be reduced.

On the other hand, in the above aspect, a description has been given of the case where the correction value acquisition process (S502) is executed when the required resolution is higher than 300 dpi (S501: Yes), however, the correction value acquisition process (S502) may not be executed when the required resolution is higher than 600 dpi.

For example, when the required resolution is 1200 dpi, it is necessary to eject seven ink ejection drops D2 to D8 between ejection drops D1 and D9 formed in the first pass. In such a case, as described above, a main scan and a sub-scan to convey the recording sheet of paper P greater than the theoretical conveyance amount may be alternately repeated for recording.

On the other hand, in such a case, without conveying the recording sheet of paper P greater than the theoretical conveyance amount, the ink can be ejected in such a manner as, for example, D3 in the second pass, D5 in the third pass, D7 in the fourth pass, D2 in the fifth pass, D4 in the sixth pass, D6 in the seventh pass, and D8 in the eighth pass, so as not to be contiguous with an ink ejection drop formed in the previous main scan. That is, when it is possible to perform recording so as not to be contiguous in the sub-scanning direction by the next main scan with respect to an ink ejection drop formed in the previous main scan, by performing control so as to change the order in which the ink is ejected, the process load to calculate the correction value can be reduced without causing a streaky unevenness of ink.

Figure 7:
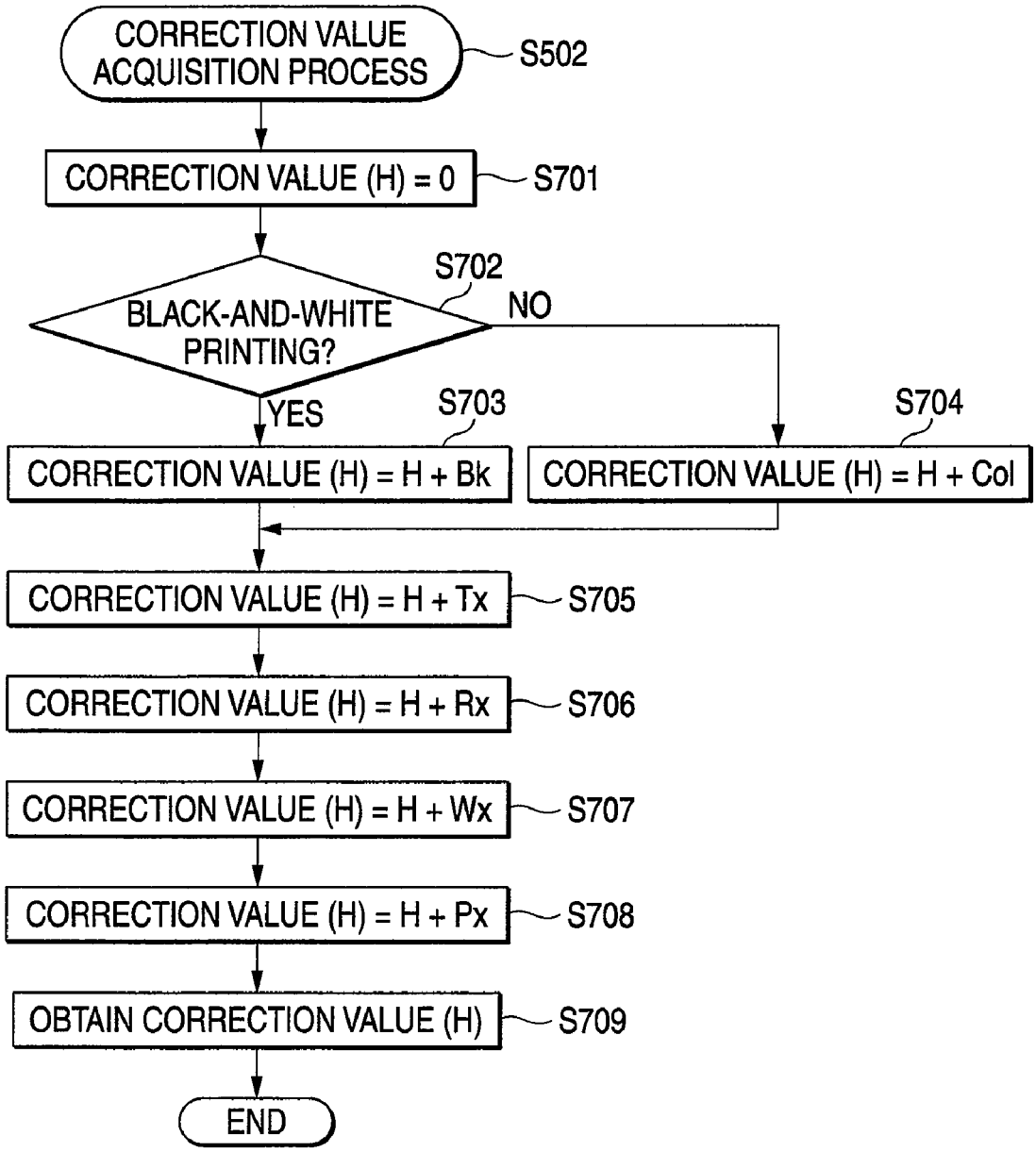
FIG. 7 is a flowchart of a correction value acquisition process.

FIG. 7 is a flowchart of the correction value acquisition process of S502 shown in the printing process flowchart of FIG. 5. This process is a process to acquire a correction value showing how much distance the recording sheet of paper P is conveyed relative to the theoretical conveyance amount. In the process, first, the correction value (H) is initialized (S701). And, the printing method designated in the print data is detected to determine whether it is black-and-white printing (S702). If it is black-and-white printing (S702: Yes), the correction value "BK" in the case of black-and-white printing of the printing method table 35*a* shown in FIG. 4A is added to the correction value (H). On the other hand, if it is not black-and-white printing (S702: No), the correction value "Col" in the case of a color printing mode of the same table 35*a* is added to the correction value (H) determining it as color printing (S704). Thereby, a correction value corresponding to an ink spread that changes due to a factor of the ink type can be acquired.

Next, a correction value resulting from the outside-air temperature is added. Concretely, an outside-air temperature x is detected by the thermistor 47, and the detected outside-air temperature x is multiplied by "T" as being a correction parameter of the outside-air temperature of the correction value parameter table 35*c* shown in FIG. 4C, and a correction value Tx resulting from the outside-air temperature is added to the correction value (H) (S705). Thereby, a correction value corresponding to an ink spread that changes due to a factor of the outside-air temperature can be acquired.

Next, a correction value resulting from the required resolution is added. Concretely, a required resolution x is detected from the print data, and the detected required resolution x is multiplied by "R" as being a correction parameter of the required resolution of the correction value parameter table 35*c* shown in FIG. 4C, and a correction value Rx resulting from the required resolution is added to the correction value (H) (S706). Thereby, a correction value corresponding to an ink spread that changes due to a factor of the required solution can be acquired.

Next, a correction value resulting from the drying time is added. Concretely, a drying time x is detected from the print data, and the detected drying time x is multiplied by "W" as being a correction parameter of the drying time of the correction value parameter table 35*c* shown in FIG. 4C, and a correction value Wx resulting from the drying time is added to the correction value (H) (S707). Thereby, a correction value corresponding to an ink spread that changes due to a factor of the drying time can be acquired.

Lastly, a correction value resulting from the sheet type is added. Concretely, a sheet type is detected from the sheet type designated by a user, and in a manner corresponding to the detected sheet type, a correction value "Px" stored in the sheet type table 35*b* shown in FIG. 4B is added to the correction value (H) (S708). Thereby, a correction value corresponding to an ink spread that changes due to a factor of the sheet type can be acquired.

According to the inkjet printer 1 described as such, the predetermined conveyance amount when conveying a recording medium in the sub-scanning direction by one sub-scan is set greater than the theoretical conveyance amount, so that with respect to ink that is ejected on the recording medium by one sub-scan, ink to be ejected by the next main scan so as to be contiguous upstream in the sub-scanning direction of the previously ejected ink is ejected upstream in the sub-scanning direction away from a theoretical position. Therefore, even if the previously ejected ink has not dried, the ink to be ejected by the next main scan is suppressed from being drawn, due to the previously ejected ink, toward the previously ejected ink. Accordingly, the interval between the ink ejection drops lined in the sub-scanning direction is roughly made uniform so that recording quality can be improved.

Figure 8A:
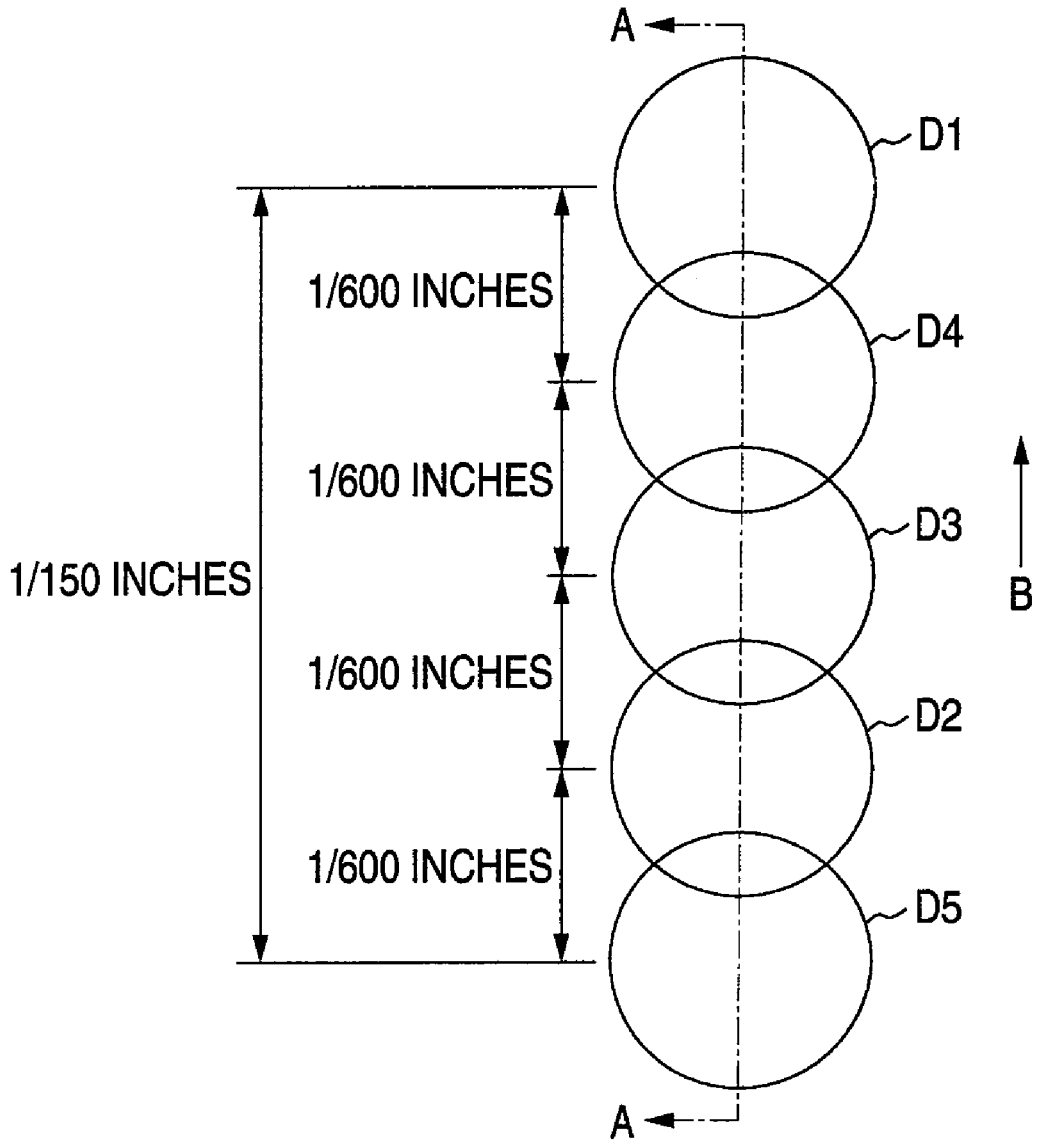
FIGS. 8A to 8C are diagrams for explaining another recording method.
Figures 8B, 8C:
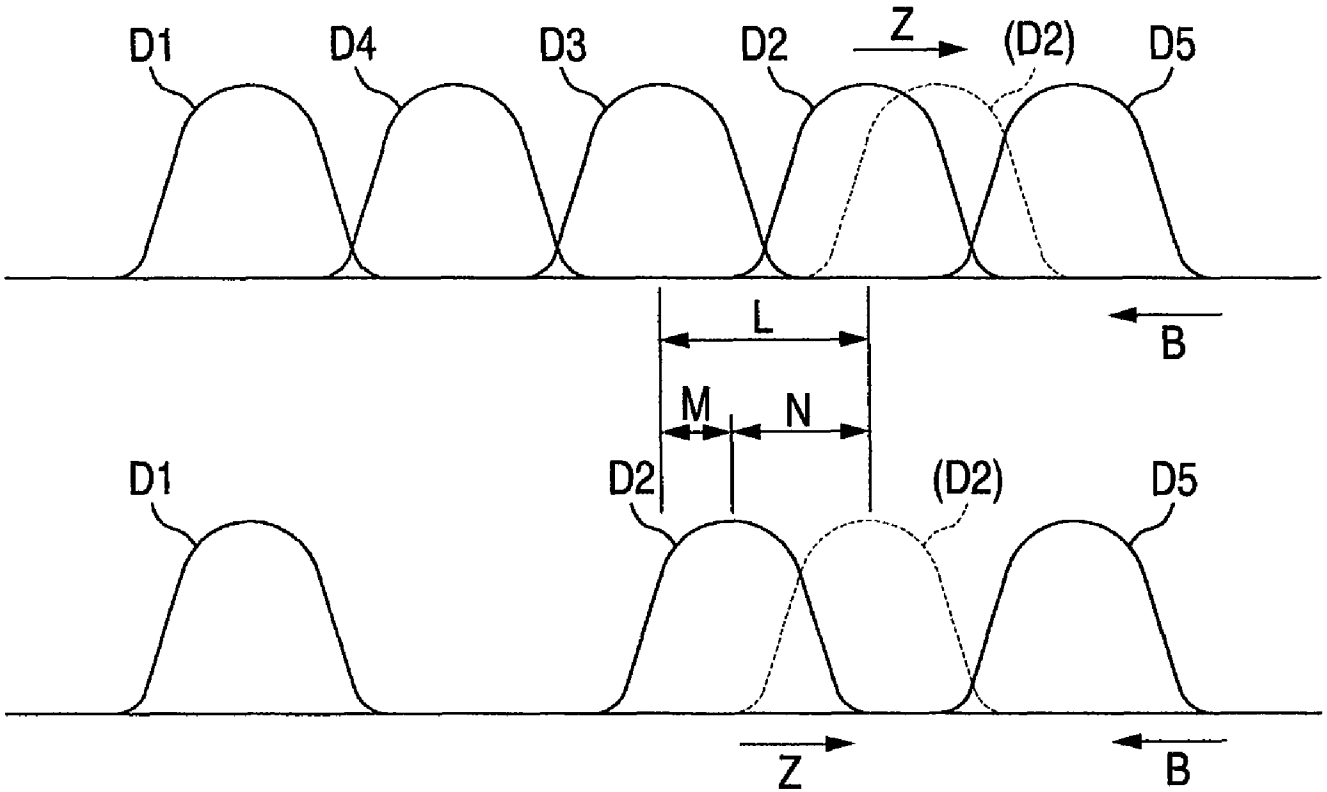

Next, as shown in FIGS. 8A to 8C, description will be given of a case where recording is performed by a method different from that in the above aspect. FIG. 8A is a diagram showing a condition of the ink ideally ejected on a recording medium, and FIG. 8B is a sectional diagram along an A-A section line of FIG. 8A. FIG. 8C is a sectional diagram showing a condition where the first-pass main scan has been carried out, the recording medium has been conveyed at a conveyance amount smaller than the theoretical conveyance amount, and then the second-pass main scan has been carried out.

In the above aspect, a description has been given of a case where, as shown in FIG. 11(*a*), after ejection drops D1 and D5 are formed in the first pass, ejection drops D2, D3, and D4 are formed in order from the upstream side in the sub-scanning direction of the ejection drop D1. The different recording method is a method, as shown in FIG. 8A, for forming, after forming ejection drops D1 and D5 in the first pass, ejection drops D2, D3, and D4 in order from the downstream side in the sub-scanning direction of the ejection drop D5.

However, by this recording method, as shown in FIG. 8B, the ejection drop D2 to be formed in the second pass is formed so as to be contiguous, downstream in the sub-scanning direction B, with respect to the ejection drop D5 formed in the first pass, and thus when the ejection drop D2 is formed before the ejection drop D5 has dried, a problem arises such that the ejection drop D2 is drawn toward the ejection drop D5 (arrow Z direction) due to the effect of surface tension and the like of the ejection drop D5 (see the dotted line of the ejection drop (D2)), overlap between the ejection drop D5 and ejection drop (D2) increases, conversely, overlap between the ejection drop D2 and ejection drop D3 decreases, and this is produced as a streaky unevenness of ink (banding) to degrade recording quality.

Therefore, by the different method, as shown in FIG. 8C, after the ejection drops D1 and D5 are formed in the first pass, although normally conveyed by a theoretical conveyance amount L, the recording medium is conveyed by a conveyance amount N obtained by subtracting a correction amount M from the theoretical conveyance amount L, that is, smaller than the theoretical conveyance amount, and at that position, the ejection drop D2 in the second pass is formed. Thereby, the ejection drop D2 formed in the second pass is drawn to the undried ejection drop D5 formed in the first pass (see ejection drop (D2) shown by the dotted line of FIG. 8C), and is finally fixed at an optimal position, and thus occurrence of a streaky unevenness of ink (banding) is suppressed, so that recording quality can be improved.

Moreover, in such a case of the recording method for forming ejection drops in order from the downstream side in the sub-scanning direction of a ejection drop located upstream in the sub-scanning direction B formed in the first pass, by contrarily subtracting the respective correction values so that the conveyance amount becomes smaller than the theoretical conveyance amount in the above aspect, a high-quality image can be formed.

Although the present invention has been described based on the aspect in the above, the present invention is not limited to the above aspect, and it can be easily speculated that various modifications can be made within a scope not deviating from the spirit of the invention.

For example, in the above embodiment, a description has been given of the case where a correction value is determined from a table, however, a method for determining a correction value is not limited to such a method, and a correction value may be determined by a numerical expression or a graph.

According to the above aspects, the predetermined conveyance amount when conveying a recording medium in the sub-scanning direction by one sub-scan is set greater than the theoretical conveyance amount. Therefore, with respect to ink that is ejected on the recording medium by one sub-scan, ink to be ejected by the next main scan so as to be contiguous upstream in the sub-scanning direction of the previously ejected ink is ejected upstream in the sub-scanning direction away from a theoretical position. Therefore, even if the previously ejected ink has not dried, the ink to be ejected by the next main scan is suppressed from being drawn, due to the previously ejected ink, toward the previously ejected ink. Accordingly, the interval between the ink ejection drops lined in the sub-scanning direction is roughly made uniform, so that there is an effect that recording quality can be improved.

According to the above, the predetermined conveyance amount is set greater as the ink to be ejected on the recording medium spreads more easily. Therefore, the degree of an ink spread that changes due to various factors is accepted. Further, recording quality can be improved in comparison with that when the predetermined conveyance amount is fixed at a certain value.

According to the above, the ink spreads more easily in the first mode for recording by use of an ink made mainly from pigments than in the second mode for recording by use of an ink made mainly from dyes. Therefore, recording quality can be improved by setting the predetermined conveyance amount greater in the first mode than in the second mode.

According to the above, the ink spreads more easily as the outside-air temperature is higher. Therefore, recording quality can be improved by setting the predetermined conveyance amount greater as the outside-air temperature is higher.

According to the above, the ink spreads more easily as the required resolution is lower. Therefore, recording quality can be improved by setting the predetermined conveyance amount greater as the required resolution is lower.

According to the above, the ink spreads more easily as the time required until a next main scan after one main scan is shorter. Therefore, recording quality can be improved by setting the predetermined conveyance amount greater as the time required until a next main scan after one main scan is shorter.

According to the above, the ink spreads more easily as the recording medium has a higher ink penetration. Therefore, recording quality can be improved by setting the predetermined conveyance amount greater as the recording medium has a higher ink penetration.

According to the above, since the predetermined conveyance amount is set greater than the theoretical conveyance amount only when it has been determined that the required resolution is higher than the first resolution, it is sufficient to convey the recording medium as determined by the theoretical conveyance amount when the required resolution is lower than the first resolution. Therefore, a calculation load necessary for determining the predetermined conveyance amount can be reduced.

According to the above, the recording head is constructed so as to be capable of recording at a resolution equal to or lower than the second resolution in the sub-scanning direction by one main scan, and the first resolution is set to a resolution equal to or more than twice the second resolution, so that when ejecting an ink by a next main scan at almost the center of the inks ejected side by side in the sub-scanning direction by one main scan, the conveyance amount is not set to the predetermined conveyance amount but is set to the theoretical conveyance amount. Therefore, by setting the conveyance amount to the predetermined conveyance amount, the ink to be ejected by the next main scan can be prevented from being drawn to the ink, of the inks ejected by the previous main scan, upstream in the sub-scanning direction. Accordingly, there is an effect that recording quality can be improved.

According to the above, since the predetermined conveyance amount is set greater than the theoretical conveyance amount only when it has been determined that the required resolution is higher than the third resolution, it is sufficient to convey the recording medium as determined by the theoretical conveyance amount when the required resolution is higher than the third resolution. Therefore, a calculation load necessary for determining the predetermined conveyance amount can be reduced.

According to the above, the recording head is constructed so as to be capable of recording at a resolution equal to or lower than the second resolution in the sub-scanning direction by one main scan, and the third resolution is set to a resolution equal to or more than five times the second resolution. Therefore, when ejecting four or more inks from the next time onward between inks ejected side by side in the sub-scanning direction by one main scan, the conveyance amount is not set to the predetermined conveyance amount but is set to the theoretical conveyance amount. Therefore, a calculation load necessary for determining the predetermined conveyance amount can be reduced by ejecting inks so as not to be contiguous in the sub-scanning direction with respect to the previously ejected inks.

According to the above, the predetermined conveyance amount when conveying a recording medium in the sub-scanning direction by one sub-scan is set smaller than the theoretical conveyance amount, so that with respect to ink that is ejected on the recording medium by one sub-scan, ink to be ejected by the next main scan so as to be contiguous upstream in the sub-scanning direction of the previously ejected ink is ejected upstream in the sub-scanning direction away from a theoretical position. Therefore, even if the previously ejected ink has not dried, the ink to be ejected by the next main scan is suppressed from being drawn, due to the previously ejected ink, toward the previously ejected ink. Accordingly, the interval between the ink ejection drops lined in the sub-scanning direction is roughly made uniform, so that there is an effect that recording quality can be improved.

According to the above, the predetermined conveyance amount is set smaller as the ink to be ejected on the recording medium spreads more easily. Therefore, the degree of an ink spread that changes due to various factors can be accepted, so that there is an effect that recording quality can be improved in comparison with that when the predetermined conveyance amount is fixed at a certain value.

According to the above, the ink spreads more easily in the first mode for recording by use of an ink made mainly from pigments than in the second mode for recording by use of an ink made mainly from dyes. Therefore, recording quality can be improved by setting the predetermined conveyance amount smaller in the first mode than in the second mode.

According to the above, the ink spreads more easily as the outside-air temperature is higher. Therefore, recording quality can be improved by setting the predetermined conveyance amount smaller as the outside-air temperature is higher.

According to the above, the ink spreads more easily as the required resolution is lower. Therefore, recording quality can be improved by setting the predetermined conveyance amount smaller as the required resolution is lower.

According to the above, the ink spreads more easily as the time required until a next main scan after one main scan is shorter. Therefore, recording quality can be improved by setting the predetermined conveyance amount smaller as the time required until a next main scan after one main scan is shorter.

According to the above, the ink spreads more easily as the recording medium has a higher ink penetration. Therefore, recording quality can be improved by setting the predetermined conveyance amount smaller as the recording medium has a higher ink penetration.

According to the above, since the predetermined conveyance amount is set smaller than the theoretical conveyance amount only when it has been determined that the required resolution is higher than the first resolution, it is sufficient to convey the recording medium as determined by the theoretical conveyance amount when the required resolution is lower than the first resolution. Therefore, a calculation load necessary for determining the predetermined conveyance amount can be reduced.

According to the above, the recording head is constructed so as to be capable of recording at a resolution equal to or lower than the second resolution in the sub-scanning direction by one main scan, and the first resolution is set to a resolution equal to or more than twice the second resolution. Therefore, when ejecting an ink by a next main scan at almost the center of the inks ejected side by side in the sub-scanning direction by one main scan, the conveyance amount is not set to the predetermined conveyance amount but is set to the theoretical conveyance amount. Therefore, by setting the conveyance amount to the predetermined conveyance amount, the ink to be ejected by the next main scan can be prevented from being drawn to the ink, of the inks ejected by the previous main scan, upstream in the sub-scanning direction. Accordingly, there is an effect that recording quality can be improved.

According to the above, since the predetermined conveyance amount is set smaller than the theoretical conveyance amount only when it has been determined that the required resolution is higher than the third resolution, it is sufficient to convey the recording medium as determined by the theoretical conveyance amount when the required resolution is higher than the third resolution. Therefore, a calculation load necessary for determining the predetermined conveyance amount can be reduced.

According to the above, the recording head is constructed so as to be capable of recording at a resolution equal to or lower than the second resolution in the sub-scanning direction by one main scan, and the third resolution is set to a resolution equal to or more than five times the second resolution. Therefore, when ejecting four or more inks from the next time onward between inks ejected side by side in the sub-scanning direction by one main scan, the conveyance amount is not set to the predetermined conveyance amount but is set to the theoretical conveyance amount. That is, in such a case, by ejecting inks so as not to be contiguous in the sub-scanning direction with respect to the previously ejected inks, there is an effect that a calculation load necessary for determining the predetermined conveyance amount can be reduced.

What is claimed is:

1. An inkjet recording apparatus comprising:

a recording head that moves in a main scanning direction and ejects ink from a plurality of nozzles toward a recording medium to perform a main scan;

a conveying mechanism that conveys the recording medium in a sub-scanning direction by a predetermined conveyance amount to perform a sub-scan, the sub-scanning direction being configured to be perpendicular to the main scanning direction;

a control unit that controls the recording head and the conveying mechanism to repeat the main scan and the sub-scan alternately to eject the ink on the recording medium at a position upstream in the sub-scanning direction with an interval satisfying a required resolution from the ink ejected on the recording medium in a previous main scan, the control unit setting the predetermined conveyance amount to be greater than a theoretical conveyance amount set based on a number of the nozzles being used and the required resolution, wherein the theoretical conveyance amount is an integral multiple of an interval corresponding to the required resolution and a difference between the predetermined conveyance amount and the theoretical conveyance amount is smaller than the interval corresponding to the required resolution; and a determining unit that determines whether the required resolution is higher than a first resolution, wherein the control unit sets the predetermined conveyance amount greater than the theoretical conveyance amount only when it has been determined by the determining unit that the required resolution is higher than the first resolution;

the recording head is constructed so as to be capable of recording at a resolution equal to or lower than a second resolution in the sub-scanning direction by the main scan; and the first resolution is set to a resolution equal to or more than twice the second resolution.

2. The inkjet recording apparatus according to claim 1, further comprising a detecting unit that detects a factor that affects a spread of the ink ejected on the recording medium, wherein the control unit sets the predetermined conveyance amount greater as the ink to be ejected on the recording medium spreads more easily due to the factor detected by the detecting unit.

3. The inkjet recording apparatus according to claim 2, wherein:

the detecting unit detects a first mode for recording by use of an ink made mainly from pigments or a second mode for recording by use of an ink made mainly from dyes; and the control unit sets the predetermined conveyance amount greater when the first mode is detected by the detecting unit than when the second mode is detected.

4. The inkjet recording apparatus according to claim 2, wherein:

the detecting unit detects an outside-air temperature; and the control unit sets the predetermined conveyance amount greater as the outside-air temperature detected by the detecting unit increases.

5. The inkjet recording apparatus according to claim 2, wherein:

the detecting unit detects the required resolution; and the control unit sets the predetermined conveyance amount greater as the required resolution detected by the detecting unit decreases.

6. The inkjet recording apparatus according to claim 2, wherein:

the detecting unit detects a time interval between each of the main scans; and the control unit sets the predetermined conveyance amount greater as the time detected by the detecting unit decreases.

7. The inkjet recording apparatus according to claim 2, wherein:

the detecting unit detects a type of the recording medium; and the control unit sets the predetermined conveyance amount greater as the recording medium has a higher ink penetration, according to the type of the recording medium detected by the detecting unit.

8. The inkjet recording apparatus according to claim 1, wherein the control unit sets the predetermined conveyance amount to a constant amount.

9. An inkjet recording apparatus comprising:

a recording head that moves in a main scanning direction and ejects ink from a plurality of nozzles toward a recording medium to perform a main scan;

a conveying mechanism that conveys the recording medium in a sub-scanning direction by a predetermined conveyance amount to perform a sub-scan, the sub-scanning direction being configured to be perpendicular to the main scanning direction;

a control unit that controls the recording head and the conveying mechanism to repeat the main scan and the sub-scan alternately to eject the ink on the recording medium at a position upstream in the sub-scanning direction with an interval satisfying a required resolution from the ink ejected on the recording medium in a previous main scan, the control unit setting the predetermined conveyance amount to be greater than a theoretical conveyance amount set based on a number of the nozzles being used and the required resolution, wherein the theoretical conveyance amount is an integral multiple of an interval corresponding to the required resolution and a difference between the predetermined conveyance amount and the theoretical conveyance amount is smaller than the interval corresponding to the required resolution; and a determining unit that determines whether the required resolution is lower than a first resolution, wherein the control unit sets the predetermined conveyance amount greater than the theoretical conveyance amount only when it has been determined by the determining unit that the required resolution is lower than the first resolution, the recording head is constructed so as to be capable of recording at a resolution equal to or lower than a second resolution in the sub-scanning direction by the main scan; and the first resolution is set to a resolution equal to or more than five times the second resolution.

10. The inkjet recording apparatus according to claim 9, wherein the control unit sets the predetermined conveyance amount to a constant amount.

11. An inkjet recording apparatus comprising:

a recording head that moves in a main scanning direction and ejects ink from a plurality of nozzles toward a recording medium to perform a main scan;

a conveying mechanism that conveys the recording medium in a sub-scanning direction by a predetermined conveyance amount to perform a sub-scan, the sub-scanning direction being configured to be perpendicular to the main scanning direction;

a control unit that controls the recording head and the conveying mechanism to repeat the main scan and the sub-scan alternately to eject the ink on the recording medium at a position downstream in the sub-scanning direction with an interval satisfying a required resolution from the ink ejected on the recording medium in a previous main scan, the control unit setting the predetermined conveyance amount to be smaller than a theoretical conveyance amount that is set based on a number of the nozzles being used and the required resolution, wherein the theoretical conveyance amount is an integral multiple of an interval corresponding to the required resolution and a difference between the predetermined conveyance amount and the theoretical conveyance amount is smaller than the interval corresponding to the required resolution; and a determining unit that determines whether the required resolution is higher than a first resolution, wherein the control unit sets the predetermined conveyance amount smaller than the theoretical conveyance amount only when it has been determined by the determining unit that the required resolution is higher than the first resolution, the recording head is constructed so as to be capable of recording at a resolution equal to or lower than a second resolution in the sub-scanning direction by the main scan; and the first resolution is set to a resolution equal to or more than twice the second resolution.

12. The inkjet recording apparatus according to claim 11, further comprising a detecting unit that detects a factor that affects a spread of ink to be ejected on the recording medium, wherein the control unit sets the predetermined conveyance amount smaller as the ink to be ejected on the recording medium spreads more easily due to the factor detected by the detecting unit.

13. The inkjet recording apparatus according to claim 12, wherein:

the detecting unit detects a first mode for recording by use of an ink made mainly from pigments or a second mode for recording by use of an ink made mainly from dyes; and the control unit sets the predetermined conveyance amount smaller when the first mode is detected by the detecting unit than when the second mode is detected.

14. The inkjet recording apparatus according to claim 12, wherein:

the detecting unit detects an outside-air temperature; and the control unit sets the predetermined conveyance amount smaller as the outside-air temperature detected by the detecting unit increases.

15. The inkjet recording apparatus according to claim 12, wherein:

the detecting unit detects the required resolution; and the control unit sets the predetermined conveyance amount smaller as the required resolution detected by the detecting unit decreases.

16. The inkjet recording apparatus according to claim 12, wherein:

the detecting unit detects a time interval between each of the main scans; and the control unit sets the predetermined conveyance amount smaller as the time detected by the detecting unit decreases.

17. The inkjet recording apparatus according to claim 12, wherein:

the detecting unit detects a type of the recording medium; and the control unit sets the predetermined conveyance amount smaller as the recording medium has a higher ink penetration, according to the type of the recording medium detected by the detecting unit.

18. The inkjet recording apparatus according to claim 11, wherein the control unit sets the predetermined conveyance amount to a constant amount.

19. An inkjet recording apparatus comprising:

a recording head that moves in a main scanning direction and ejects ink from a plurality of nozzles toward a recording medium to perform a main scan;

a conveying mechanism that conveys the recording medium in a sub-scanning direction by a predetermined conveyance amount to perform a sub-scan, the sub-scanning direction being configured to be perpendicular to the main scanning direction;

a control unit that controls the recording head and the conveying mechanism to repeat the main scan and the sub-scan alternately to eject the ink on the recording medium at a position downstream in the sub-scanning direction with an interval satisfying a required resolution from the ink ejected on the recording medium in a previous main scan, the control unit setting the predetermined conveyance amount to be smaller than a theoretical conveyance amount that is set based on a number of the nozzles being used and the required resolution, wherein the theoretical conveyance amount is an integral multiple of an interval corresponding to the required resolution and a difference between the predetermined conveyance amount and the theoretical conveyance amount is smaller than the interval corresponding to the required resolution; and a determining unit that determines whether the required resolution is lower than a first resolution, wherein the control unit sets the predetermined conveyance amount smaller than the theoretical conveyance amount only when it has been determined by the determining unit that the required resolution is lower than the first resolution, the recording head is constructed so as to be capable of recording at a resolution equal to or lower than a second resolution in the sub-scanning direction by the main scan; and the first resolution is set to a resolution equal to or more than five times the second resolution.

20. The inkjet recording apparatus according to claim 19, wherein the control unit sets the predetermined conveyance amount to a constant amount.

* * * * *